US005853858A

United States Patent [19]

Bondoc

[11] Patent Number: 5,853,858

[45] Date of Patent: Dec. 29, 1998

[54] MULTIHUED SHINGLE SHEET

[75] Inventor: Alfredo A. Bondoc, Somerset, N.J.

[73] Assignee: Building Materials Corporation of America, Wayne, N.J.

[21] Appl. No.: 785,942

[22] Filed: Jan. 22, 1997

[51] Int. Cl.[6] ..... E04D 1/26

[52] U.S. Cl. ..... 428/195; 428/143; 428/144; 428/145; 428/149; 428/150; 428/206; 428/207; 428/208; 428/220; 428/81; 428/56; 428/55; 428/51; 428/48; 52/555; 52/554; 52/518; D25/139; D25/140

[58] Field of Search ..... 428/143, 144, 428/145, 149, 150, 206, 207, 208, 220, 195, 81, 56, 55, 51, 48; 52/555, 554, 518; D25/139, 140

[56] References Cited

U.S. PATENT DOCUMENTS

| | | | |
|---|---|---|---|
| 891,501 | 6/1908 | Overbury | 52/555 |
| 2,013,351 | 9/1935 | Levin | 52/555 |
| 2,068,118 | 1/1937 | Topping | 52/555 |
| 2,161,440 | 6/1939 | Venrick | 52/555 |
| 2,196,847 | 4/1940 | Rustin | 52/555 |
| 2,199,760 | 5/1940 | Schuetz | 52/555 |
| 3,624,975 | 12/1971 | Morgan et al. | 52/555 |
| 3,919,823 | 11/1975 | Bradley | 52/555 |
| 4,499,702 | 2/1985 | Turner | 52/555 |
| 4,717,614 | 1/1988 | Bondoc et al. | 52/555 |
| 5,660,014 | 8/1997 | Stahl et al. | 52/555 |
| 5,664,385 | 9/1997 | Koschitzky | 52/555 |

*Primary Examiner*—William P. Watkins, III
*Attorney, Agent, or Firm*—Marilyn J. Maue; William J. Davis

[57] ABSTRACT

This invention relates to a unitary roofing shingle sheet comprising (a) an undivided cop section having an unexposable upper portion and a lower portion carrying a partially exposable horizontal band of distinguishable colors or color patterns and (b) exposable tabs in a butt bottom section depending from the lower boundary of the band in the partially exposable portion of (a); the exposable portions of said shingle being covered with weather resistant granules of distinguishable hues or patterns disposed in discrete exposable areas in the band of section (a) and on each of said tabs so as to provide a distinctive color or pattern for each tab and a contrasting color or color pattern above each tab in the adjoining exposable portion of said band of section (a). In the shingle of the invention, the band of distinctive hues or patterns in the lower undivided portion of section (a) has a width approximately equal to the average height of the tabs in section (b); the tabs are spaced from each other by between about 0.5 and about 1.5 times the horizontal dimension of the tabs and the upper nonexposed portion of undivided section (a) has a width about equal to the width of said band plus y, wherein y has a value of from 1 to 5 inches.

14 Claims, 1 Drawing Sheet

MULTIHUED SHINGLE SHEET

FIELD OF THE INVENTION

The present unitary tabbed shingle sheet is a roof covering intended to be laid in overlapping courses wherein at least a portion of a multihued band along the lower horizontal margin in an undivided upper section of the shingle in a first course is exposable in spaces between tabs of distinguishable color or pattern in a second course.

BACKGROUND OF THE INVENTION

Roof coverings of shingle sheets have been utilized in many forms with rectangular, hexagonal, arcuate, square and irregular of tabs and tab recesses; however, these are generally supplied in uniform color imparted by mixed or single hued granules embedded on their exposable surfaces. The uniform color provides a flat, uninteresting appearance which does not resemble more expensive and aesthetically pleasing roof coverings of slate or wood shingles. Even where tabs of distinguishing hue are employed, the shingle does not achieve the tonal affects inherent in natural wood or slate shingles. In an attempt to provide dimensional variation through shading, composite shingles having mixed color tabs with shadow outlined backup strips have been proposed; however, the affect achieved is too uniform and repetitive to appear natural and the cost of producing the composite together with the expense of shipping and installing these heavier shingles is greatly increased. Accordingly, it is an object of this invention to provide a roof covering requiring a minimum of shingle material which more closely resembles the color gradations and hues associated with roof coverings of natural slate or wood shakes. These and other objects of the invention will become apparent from the following description and disclosure.

SUMMARY OF THE INVENTION

In accordance with this invention, there is provided a unitary roofing shingle sheet comprising (a) an undivided top section having an unexposable upper portion and a lower portion carrying a partially exposable horizontal band of distinguishable colors or color patterns and (b) exposable spaced tabs in a butt bottom section depending from the lower boundary of the partially exposable band of section (a) said tabs having an average height approximately equal to the width of said band. The exposable portions of the present shingle are covered with weather resistant granules of a distinguishable color or color pattern and each color or pattern is displayed separately on a tab and in a discrete area of said band to provide a distinctive color or color pattern for each tab and a contrasting color or color pattern between each tab and the adjoining exposable portion in the band of section (a) from which it depends.

Each shingle carries from 3 to 6 tabs which are spaced between about 0.5 and about 1.5 times the width of a tab which can be of any known shape disclosed above with correspondingly shaped spaces defining the separations between the tabs. Also the tabs have an average height, of between about 4 and about 6 inches, and the height of the individual tabs can vary between about 1/16 and about 1 inch with respect to each other. The tabs have a width of from 3 to 8 inches. In a preferred embodiment, the tabs are of substantially equal height and have right angled corners. Most preferably, the tabs are rectangular in shape.

The width of the unexposed upper portion of section (a) is approximately equal the to width of the horizontal band plus y wherein y has a value of from about 1 to about 5 inches. The width of the band is preferably between about 3 and about 6 inches which is equal to or closely approaches the average height of the tabs. In a most preferred embodiment of the invention, the overall shingle sheet width is between 16 and 18 inches, the tab height is between 4.5 and 5.5 inches and the width of the exposable portion of section (a) is substantially equal to the height of the tabs. The unexposed portion of section (a) can be unadorned, surface coated with granules of uniform hue or can be coated with granules of the same hues employed in the distinct areas of the multihued band.

The under surface of the shingle sheet tab portion carries adhesive in a strip, series of dots, etc. or adhesive can be applied over the entire under areas of the tabs. Additionally, if desired, the sheet undersurface can include a horizontal strip of adhesive along the under surface of the band so as to reinforce attachment in environments subject to high wind velocity.

In general, the shingle sheet of this invention has a length of from about 30 to about 50 inches and a width of from about 14 to about 26 inches, preferably a width of 15–20 inches. The exposure of each shingle, i.e. height of tabs+ width of the exposable color band, can vary between about 3 and about 8 inches, preferably 4 to 6 inches.

DESCRIPTION OF THE PREFERRED EMBODIMENT

Figure 1:
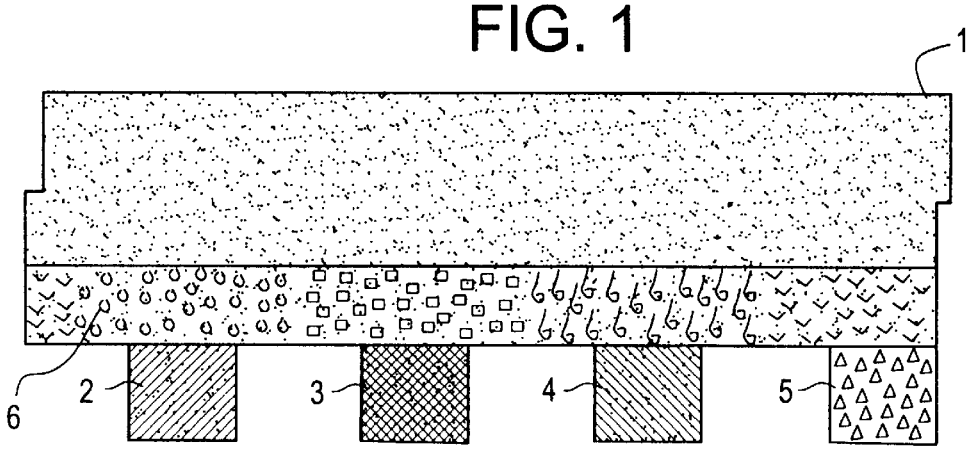
FIG. 1 is a top plan view of the present unitary shingle sheet having a band of different colors or color patterns in distinct horizontal areas located above tabs of distinguishable colors or color patterns wherein the color or color pattern of each tab is in contrast with the color or color pattern in the area of the band from which it depends.

Reference is now had to the drawings which illustrate a preferred embodiment of this invention, wherein FIG. 1 is a top plan view of unitary shingle sheet 1 showing multihued tabs 2–5 and multihued color band 6 in the exposable portion of undivided section 7. In this embodiment, the height of the tabs and the width of the band are each about 5 inches and the overall shingle width and length is about 17×40 inches; although it is to be understood that other dimensions, together with other tab heights and band widths, in accordance with the ranges set forth above, are also contemplated without departing from the scope of the invention. The hue and/or color patterns selected for the shingle sheet can vary widely depending on the effect desired. For example in this embodiment, the hues selected are those occurring in natural slate which includes tones of grey, blue, amber, red, green etc. The tones or color patterns of the granules in the discrete areas of the headlap band and tabs are indicated by different hatching, cross-hatching and shaped symbols to signify the distinguishable hues of the granules embedded in the discrete areas on the exposed surfaces of the tab and band portions of the sheet. Various color gradations and color combinations can be selected to simulate any aesthetically pleasing roof covering, e.g. wood shakes, red tile or other appropriate roof coverings.

Figure 2:
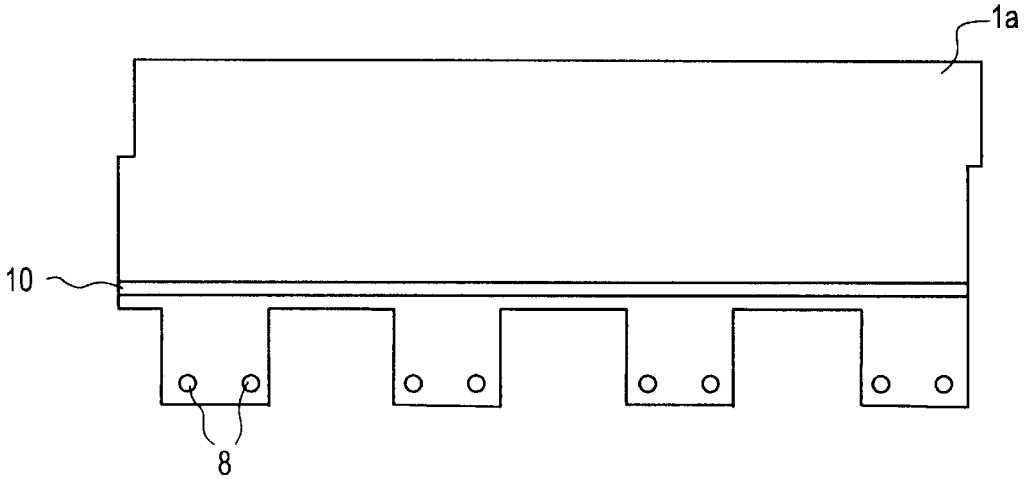
FIG. 2 is an underside plan view of the present unitary shingle sheet.

FIG. 2 represents a top plan view of the undersurface of the shingle sheet shown in FIG. 1 which is devoid of granules but which has adhesive applied in dot areas 8 on the tab undersurfaces and in horizontal strip 10 located at the back of color band 6 to provide a self sealing feature between shingles when installed.

Figure 3:
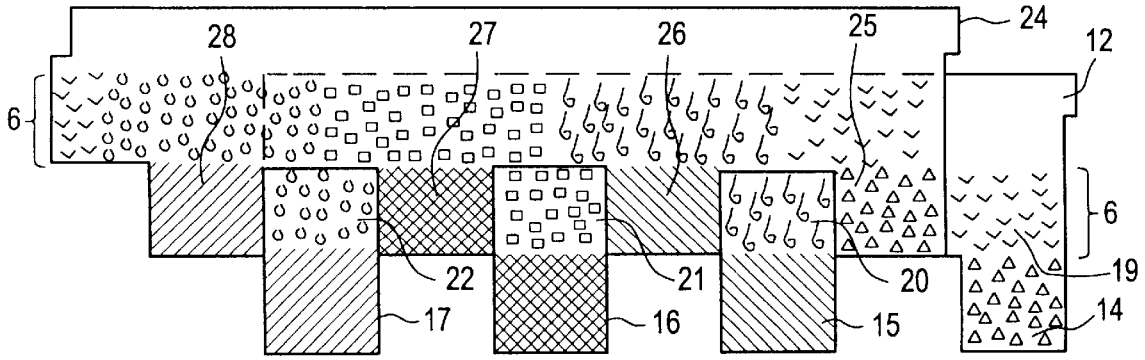
FIG. 3 is a top plan view of two successive courses of the present shingle wherein the tabs of the second course are offset and overlap the color band of the first course and each distinct color area in the band of the first course is exposed between the tabs of the second course so that the color or color pattern of each tab in the second course is distinct from the color or color pattern in the exposed band of the first course adjacent the second course tabs.

FIG. 3 represents a top plan view of two courses of shingles when installed on a roof. In a first course, first shingle sheet 12 carrying exposed tabs 14–17, each having a different hue, and color band 18 having contrasting hues in distinct areas 19–22, is overlaid by a second course represented by successive shingle sheet 24. Shingle sheet 24, which is a replica of the first shingle sheet, overlaps and is offset from shingle 12 so that the tabs of the second sheet 25–28 are disposed above the spaces between the tabs of sheet 12 and the spaces between the tabs of the second sheet reveal colors or color patterns in the band 6 of the first sheet so as to provide color contrasts between each of the tabs and spaces between tabs of the second sheet. This manner of installing courses is repeated over the entire flat surface of the roof.

Many modifications and variations of the shingle illustrated will become apparent from this disclosure without departing from the scope of the invention. For example, the tabs of the shingle can be of varying thicknesses and heights; the colors can be distinguished by shades of the same or a few colors. Other modifications will also become apparent.

I claim:

1. A unitary shingle sheet comprising (a) an undivided top section having an unexposable upper portion and a lower portion carrying a partially exposable horizontal band of distinguishable colors or color patterns in discrete areas thereof, which band extends along the lower marginal boundary of section (a) and (b) exposable spaced tabs in a bottom butt section depending from the lower boundary of said band of section (a) and having an average height approximately equal to the width of said band, wherein the color or color pattern of each tab is distinguished from the others and from the color or color pattern in the adjoining color area of the band immediately above from which the tab depends and wherein the width of the unexposable upper portion of section (a) is approximately equal to the width of said band plus y wherein y has a value of from about 1 to about 5 inches.

2. The shingle sheet of claim 1 wherein the spaces between said tabs is between about 0.5 and about 1.5 times the width of a tab and the shingle has 3 to 6 tabs of an average height from about 4 to about 6 inches.

3. The shingle sheet of claim 1 wherein the distinguishable color or color patterns are imparted by distinctively colored weather resistant granules.

4. The shingle sheet of claim 1 wherein the width of the band is between about 3 and about 6 inches.

5. The shingle sheet of claim 1 wherein the shingle length is between about 30 and about 50 inches and the width is between about 14 and about 26 inches.

6. The shingle sheet of claim 5 wherein the width of the shingle is between about 15 and about 20 inches.

7. The shingle sheet of claim 1 wherein the tabs are of equal height and have right angled corners.

8. The shingle sheet of claim 7 wherein said tabs have a rectangular shape.

9. The shingle sheet of claim 1 wherein the height of the tabs can vary between about 1/16 and about 1 inch.

10. The shingle sheet of claim 1 wherein the average width of the tabs is between about 3 and about 8 inches.

11. Successive courses of the unitary shingle of one of claims 1, 2 or 3 which are mounted in a horizontally offset manner so that the band of a first shingle is visible between the tabs of a successive shingle and the tabs of said successive shingle are surface coated with weather resistant granules of a hue or color pattern distinguishable from that in the visible portion of the band of the first shingle.

12. Successive courses of the unitary shingle of one of claims 1, 2 or 3 which are mounted in a horizontally offset manner so that the band of a first shingle is visible between the tabs of a successive shingle and the tabs of said successive shingle are surface coated with weather resistant granules of a hue or color pattern distinguishable from that in the visible portion in the band of the first shingle and wherein the width of the visible portion of said band of the first shingle is approximately equal to the height of the tabs of said successive shingle so that substantially the entire width of said band is visible between the tabs of said successive shingle and the tabs of the successive shingle are of a hue or pattern distinguishable from that of said band portion which borders the tab.

13. Successive courses of shingles of claim 1 which are horizontally mounted in an offset overlapping manner so that the color band areas of one course are exposed between the tabs of a successive course and the tabs of both courses are exposed to display granules of distinguishing color between the tabs and between the tabs and the adjacent exposed portion of the color band exposed between courses.

14. The courses of shingles as in claim 12 wherein the height of the tabs in both courses are approximately equal.

* * * * *